US005285901A

United States Patent [19]

Huang

[11] Patent Number: 5,285,901

[45] Date of Patent: Feb. 15, 1994

[54] SHOCK-PROOF PACKING AND DISPLAYING BOX

[75] Inventor: Cary Huang, Taipei, Taiwan

[73] Assignee: Cradle Design Co., Taipei, Taiwan

[21] Appl. No.: 936,444

[22] Filed: Aug. 28, 1992

[51] Int. Cl.[5] ..... B65D 85/38

[52] U.S. Cl. ..... 206/521; 206/320; 206/461

[58] Field of Search ..... 206/45.14, 45.31, 45.34, 206/305, 320, 461, 471, 576, 521

[56] References Cited

U.S. PATENT DOCUMENTS

| | | | |
|---|---|---|---|
| 3,325,079 | 6/1967 | Puckett | 206/45.14 |
| 3,670,881 | 6/1972 | Dutcher | 206/45.34 |
| 4,180,165 | 12/1979 | Kuchenbecker | 206/45.31 |
| 4,848,577 | 7/1989 | Hoffman et al. | 206/45.34 |
| 4,922,980 | 5/1990 | Parker | 206/320 |
| 4,925,149 | 5/1990 | DiFrancesca et al. | 206/320 |
| 5,080,155 | 1/1992 | Crozier | 206/320 |

FOREIGN PATENT DOCUMENTS

| | | | |
|---|---|---|---|
| 0115757 | 11/1969 | Denmark | 206/461 |

*Primary Examiner*—Jimmy G. Foster
*Attorney, Agent, or Firm*—Browdy and Neimark

[57] ABSTRACT

An improved shock-proof displaying and packing box adapted for a computer keyboard is a combination of a one-piece board folded into a topless case and a modified transparent dust cover for a keyboard which can be firmly engaged with the folded case serving as a top cover. The dust cover is mounted on top of a computer keyboard which is located in the unfolded board first and wrapped by the folded case then whereby the computer keyboard can be safely packed therein and clearly displayed for commercial purpose in a store. The one-piece board is made up of a front, rear, left and right side flap each of which has an extended top fold, and an inner fixing fold that are integrally connected but foldably separated respectively by a folding line; and four reinforcement flaps disposed at each corner of the board with each extending from a corner flap. On the periphery of each inner fixing fold are disposed a plurality of recessed cuts so as to form a number of engagement inserts therealong; the modified transparent cover is provided with a number of elongated grooves and protrusions on the edges thereof which are in engagement with the corresponding inserts and the recessed cuts on the periphery of each fold thereof so as to firmly fix the dust cover in place.

5 Claims, 13 Drawing Sheets

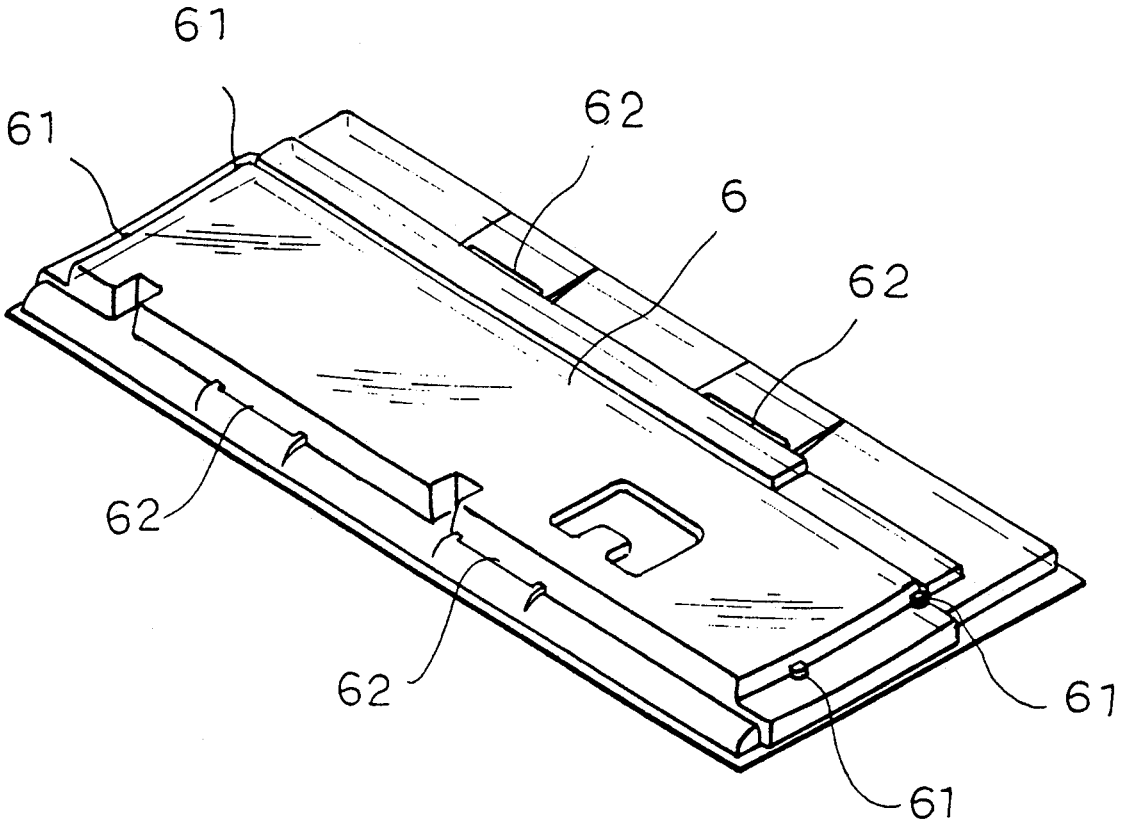
2-A

SHOCK-PROOF PACKING AND DISPLAYING BOX

BACKGROUND OF THE INVENTION

The present invention relates to an improved shock-proof packing and displaying box which is made up of a one-piece board folded into a topless case and a modified dust cover commonly disposed on top of a computer keyboard which can be firmly engaged with the topless case so as to integrate the two into a box for both packing and displaying purpose.

As shown in FIG. 1, the conventional packing box is a one piece board folded into a box form with a foldable top cover disposed thereon, and an item, such as a computer keyboard, is housed therein unvisibly when the top cover is closed. The prior art packing box is made up of a one piece board having a bottom piece with four side pieces extended therefrom, the four side pieces are folded and engaged with each other into a box and fixed in place by way of protrusions and slots. To prevent the item housed therein from being damaged as a result of vibration or shock in delivery, some buffer or shock absorbing material made of foamed polystyrene is used to protect the item inside and also to hold the same firmly in place.

Such prior art packing box has some disadvantages in practical application; the use of this kind of packing box makes the packing process complicated and time consuming; and the inside buffer material can cause serious enviromental problems when discarded at random; moreover, the structure of the conventional packing box is material wasting due to the addition of a foldable cover; and the weight thereof is relatively heavy and the cost thereof is high, causing the delivery expense of the boxes high; besides, the conventional dust cover is disposed inside a packing box or is packed uneconomically in a separate manner; and the item received in the closed box can not be exposed for displaying in a store and must be taken out thereof.

SUMMARY OF THE INVENTION

The primary object of the present invention is to provide an improved shock-proof packing and displaying box which combines a modified transparent dust cover of a computer keyboard with a one piece board which can be folded into a topless case so as to permit the so structured box to be used for both packing and displaying purposes.

Another object of the present invention is to provide an improved shock-proof packing and displaying box which is provided with a reinforcement piece at each corner of the one-piece board so as to increase the strength of the box.

One further object of the present invention is to provide an improved shock-proof packing and displaying box which can lower the packing cost and delivery expense of the packing material.

One still further object of the present invention is to provide an improved shock proof packing and 5 displaying box which can minimize the packing material used so as to contribute to the enviromental protection by producing no enviroment pollution waste.

BRIEF DESCRIPTION OF THE DRAWINGS

FIG. 2A is a transparent dust cover for a computer keyboard used in the present invention;

DETAILED DESCRIPTION OF THE PREFERRED EMBODIMENT

Figure 1:
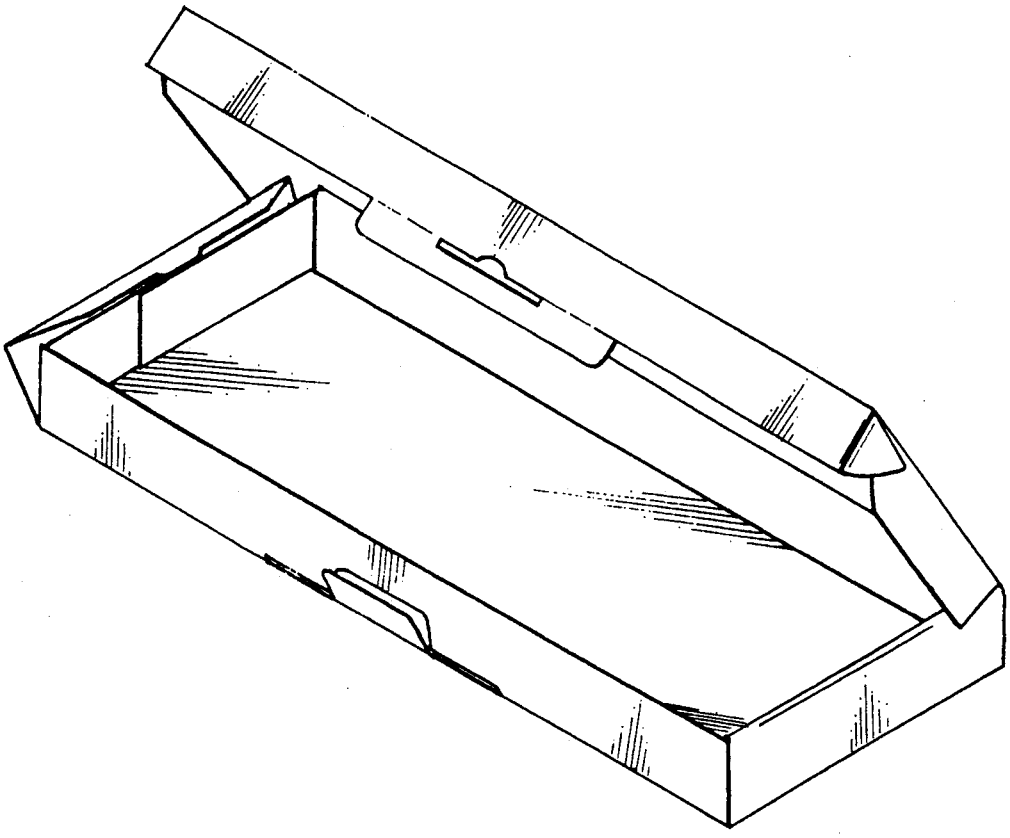
FIG.1 (PRIOR ART)
FIG. 1 is a diagram showing a prior art packing box.
Figure 2:
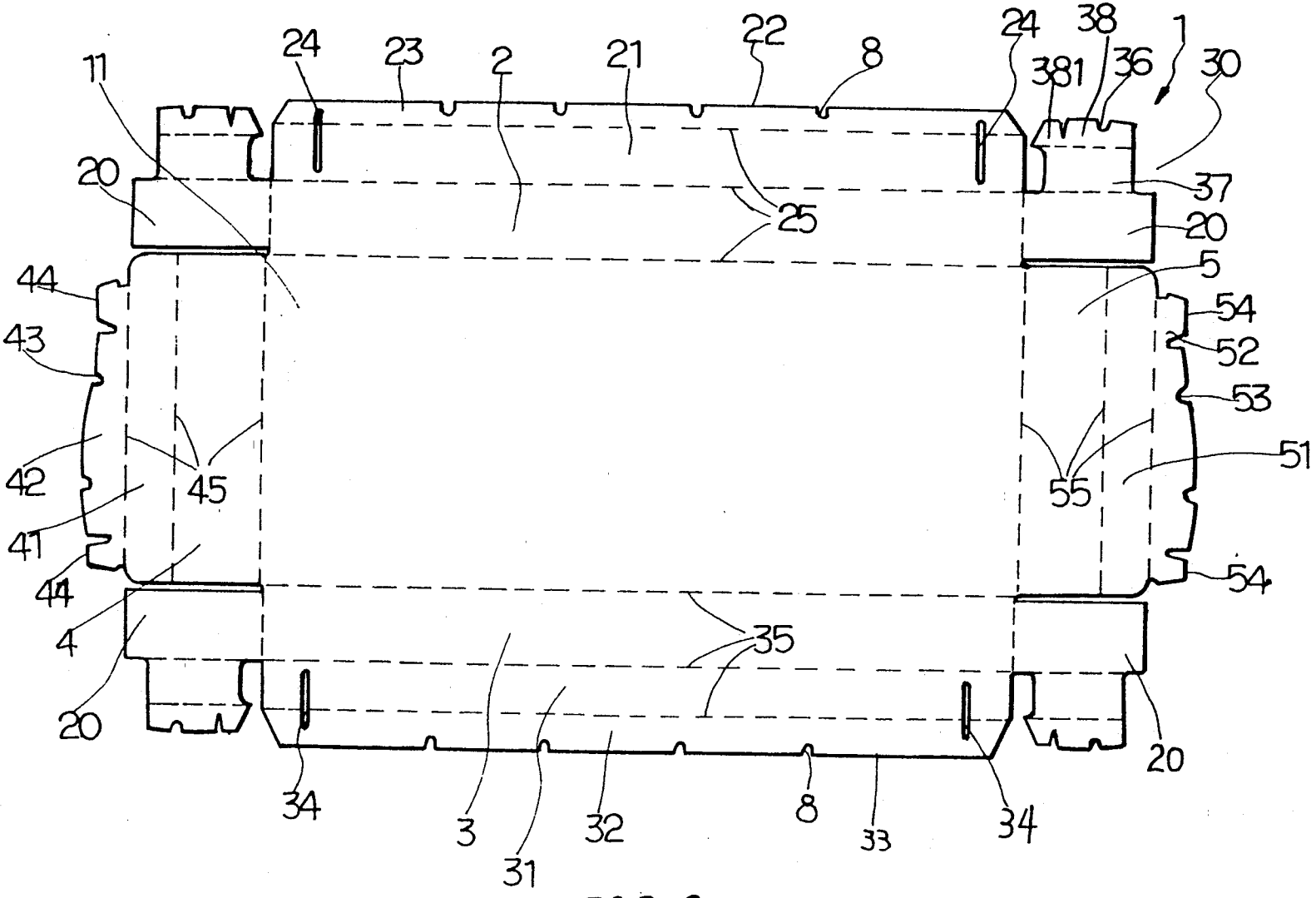
FIG. 2 is a plane view of the one piece board of the present invention.
Figure 3:
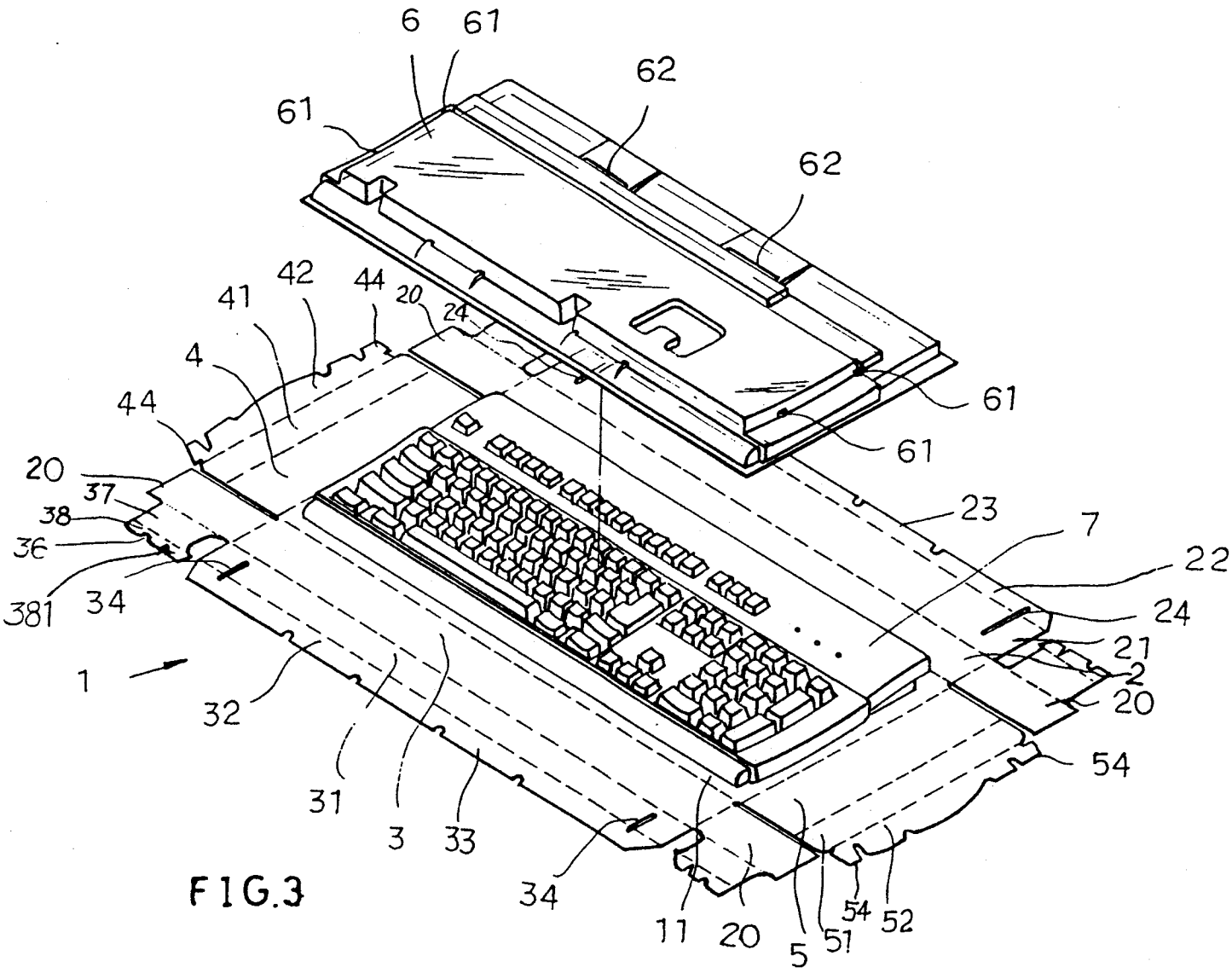
FIG. 3 is a perspective diagram showing the exploded components of the present invention.

Referring to FIGS. 2, 3, the present packing and displaying box is comprised of a one-piece board 1 and a modified dust cover 6 which is commonly used to prevent a computer keyboard from dust and direct impact. The one-piece board 1 is made up of a box base 11, a front, rear, left and right side flap 2, 3, 4, 5; and a corner flap 20 having a reinforcement flap 30 connected thereto being disposed at each corner thereof. Each reinforcement flap 30 comprises a base piece 37, a retaining piece 38 which is provided with an engagement insert 381.

The front, rear, left and right side flaps 2, 3, 4, 5 are provided with an extended top fold 21, 31, 41, 51 and an extended inner fixing fold 22, 32, 42, 52 respectively. An elongated slot 24, 34 is disposed at each end of the extended top fold 21, 31 respectively; and some of the elongated slots 24, 34 extend into the inner fixing folds 22, 32. The left and right inner fixing folds 42, 52 are provided with an insertion tongue 44, 54 at each end thereof respectively.

The front and rear inner fixing folds 22, 32 are divided into five engagement inserts 23, 33 by recessed cuts 8 respectively. The left and right inner fixing folds 42, 52 are provided with a pair of retaining cuts 43, 53. On the edge of the retaining piece 38 of the reinforcement flap 30 is also provided with a retaining cut 36 which corresponds to each retaining cut 43, 53 respectively.

The modified dust cover 6, as shown in FIG. 2A, is provided with a pair of round protrusions 61 on the right and left sides thereof respectively; and a pair of elongated grooves 62 disposed on the front and rear edges thereof. The dust cover 6 is disposed on top of a computer keyboard 7 first in assembly.

To fold the one piece board 1 into a topless case, the front and rear side flaps 2, 3 are folded upward along the dotted folding lines 25, 35 so as to make the same perpendicular to the box base 11; afterwards, the top folds 21, 31 and the inner fixing folds 22, 32 are folded along the folding lines 25, 35 with each fixing fold 22, 32 perpendicular to each top fold 21, 31 respectively; and the top folds 21, 31 perpendicular to the front and rear side flaps 2, 3 whereby the front and rear side flaps and the top folds and the inner fixing folds are folded into rectangular loop shape respectively.

Next, the corner flaps 20 disposed at each end of the front and rear side flaps 2, 3 respectively are folded inward toward the side flaps in a perpendicular manner. Each reinforcement flap 30 are folded with the base piece 37 and the retaining piece 38 perpendicular to each other. To hold the reinforcement flap 30 in place with the top folds 21, 31, the engagement inserts 381 are engaged with the elongated slots 24, 34.

To fold the one-piece board 1 into a topless case, the left and right side flaps 4, 5 are folded along the folding lines 45, 55 in perpendicular to the box base 11 and the top folds 41, 51 are folded along the folding lines 45, 55, and the left and right inner fixing folds 42, 52 are also folded in perpendicular to the top folds 41, 51 respectively. To complete the folding operation, the insertion tongues 44, 54 are inserted into the elongate slots 24, 34 respectively.

Figure 4:
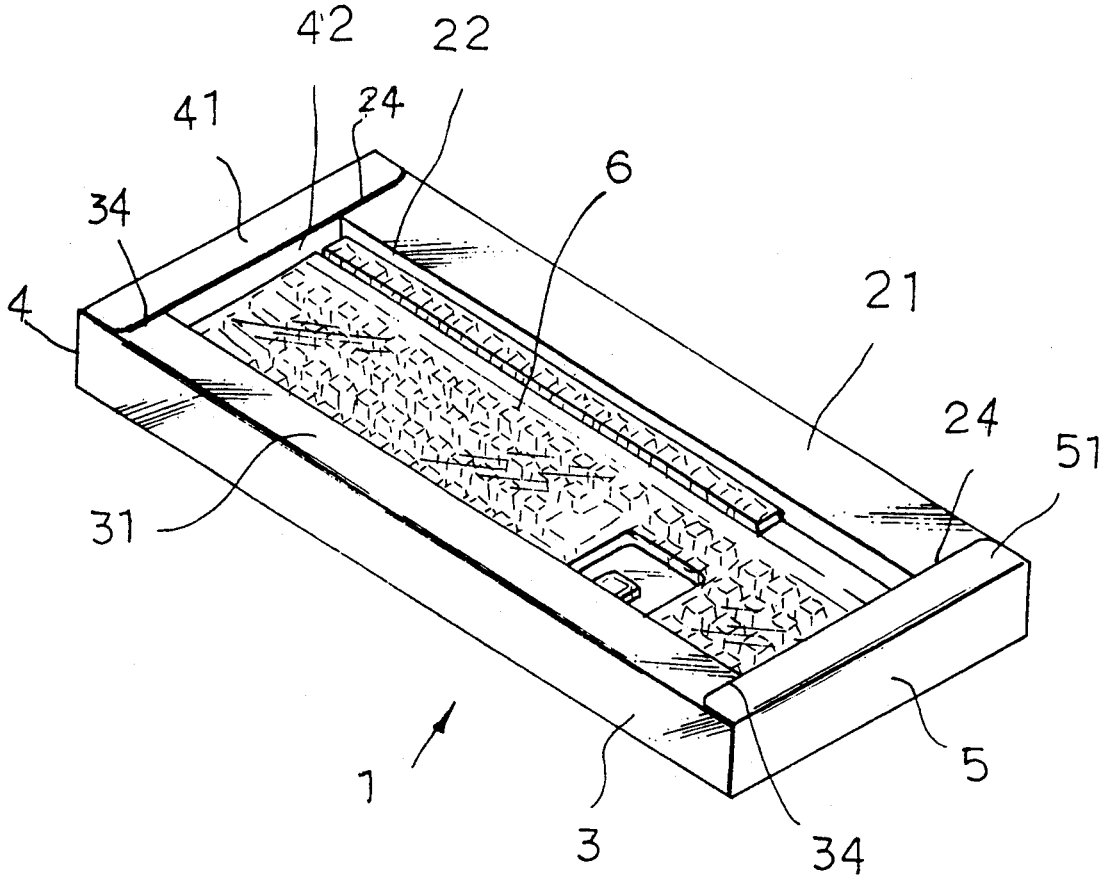
FIG. 4 is a perspective diagram showing the assembly thereof.
Figure 4A:
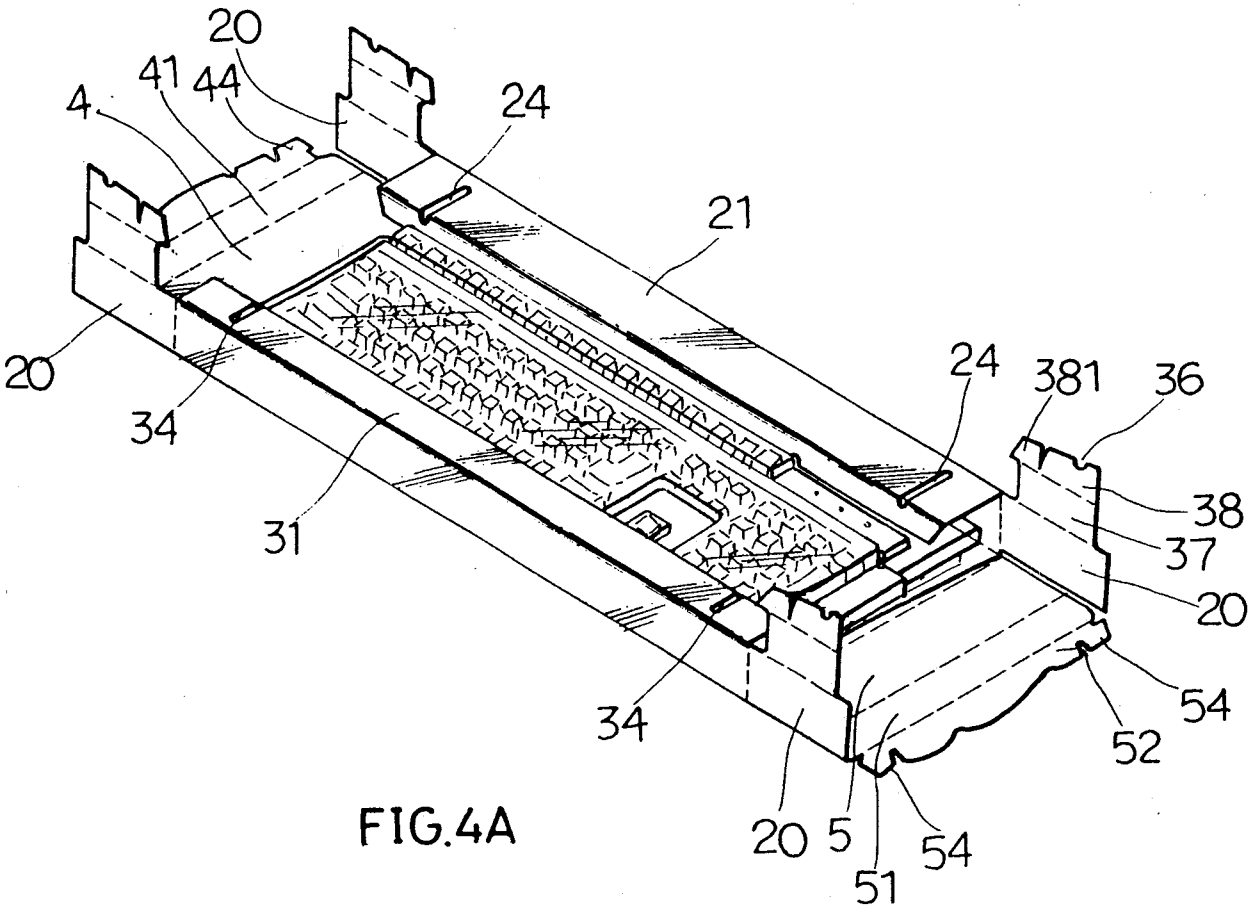
FIGS. 4A, 4B, 4C, are perspective diagrams showing the folding and fixing of the present invention.
Figure 4B:
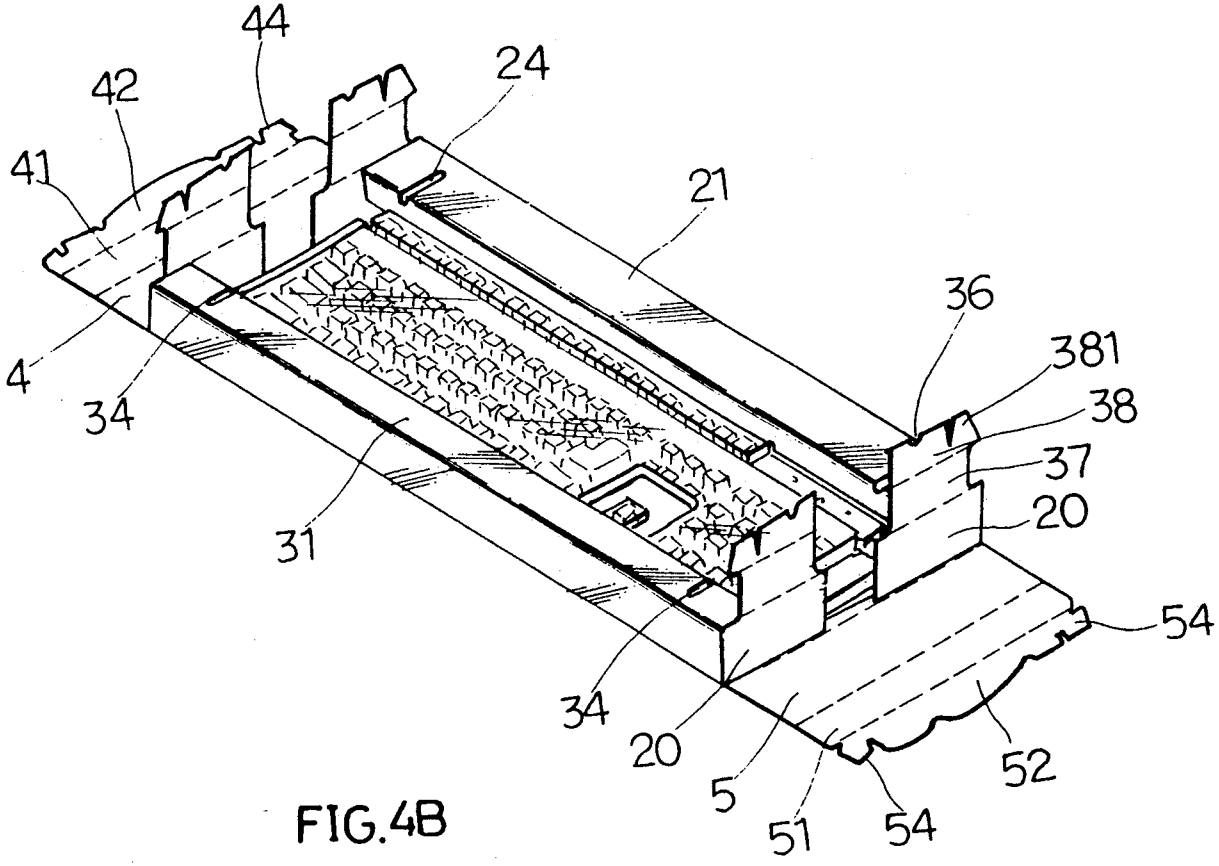
Figure 4C:
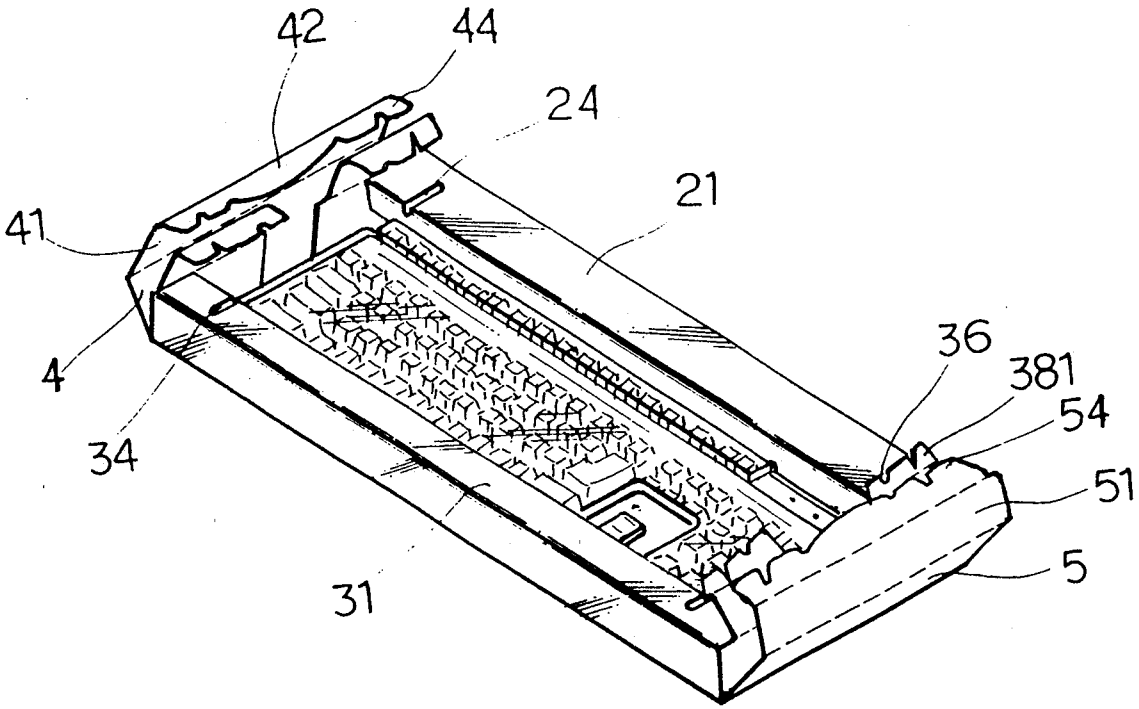
Figure 5:
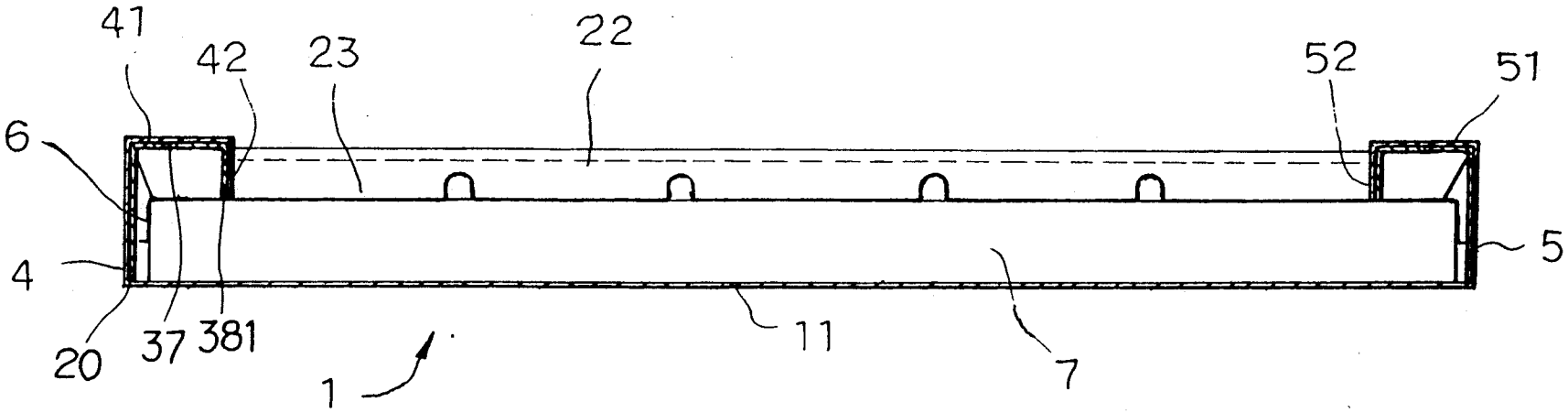
FIG. 5 is a sectional view of the assembled box of the present invention.
Figure 6:
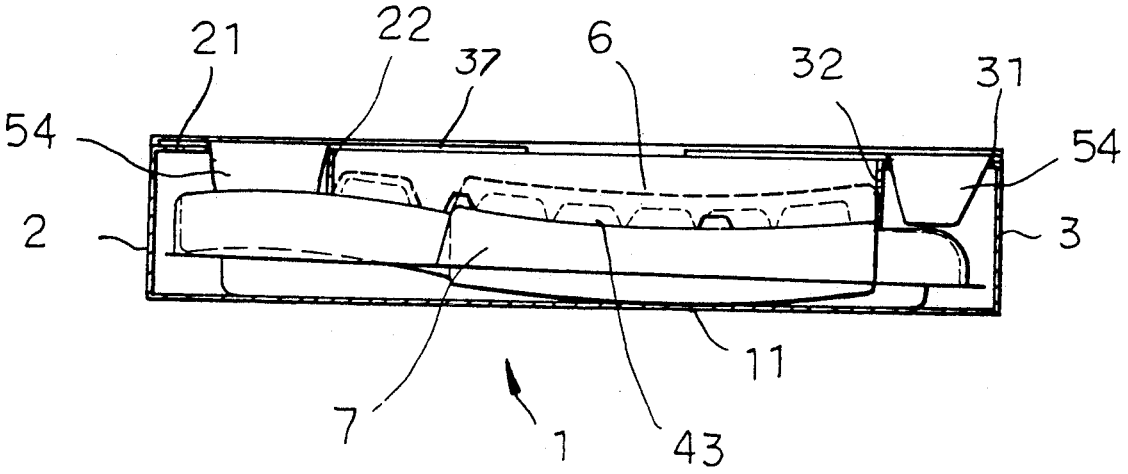
FIG. 6 is another sectional view of the assembled box.
Figure 7A:
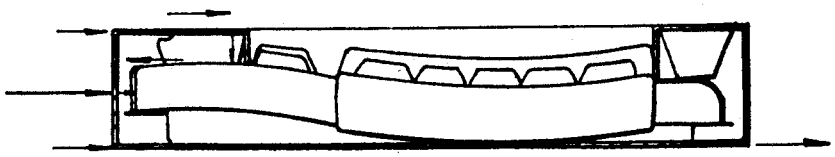
FIG. 7A to FIG. 7E are diagrams showing the exertion of external forces on the packing box of the present invention.
Figure 7B:
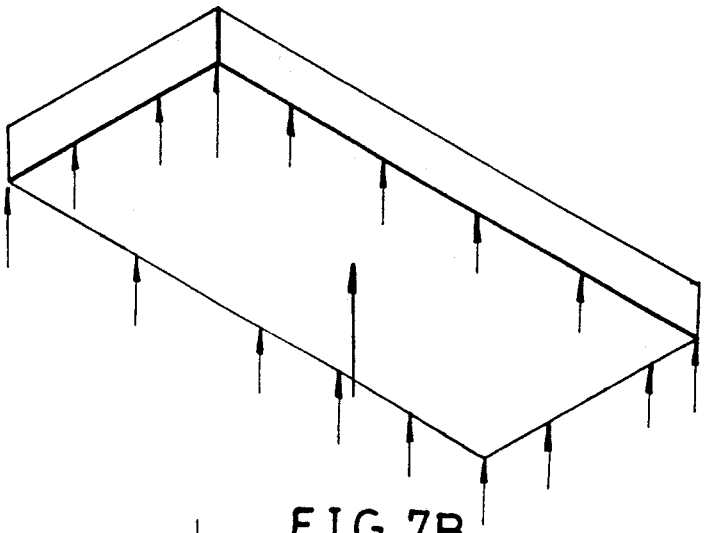
Figure 7C:
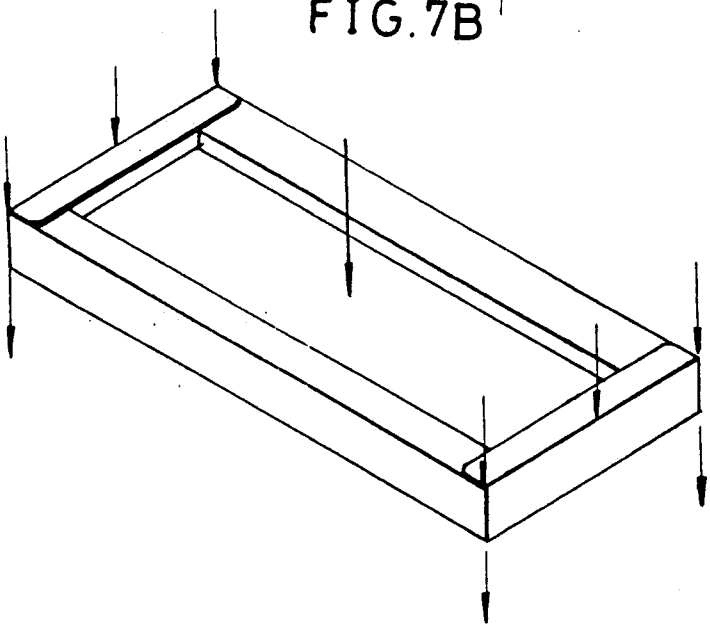
Figure 7D:
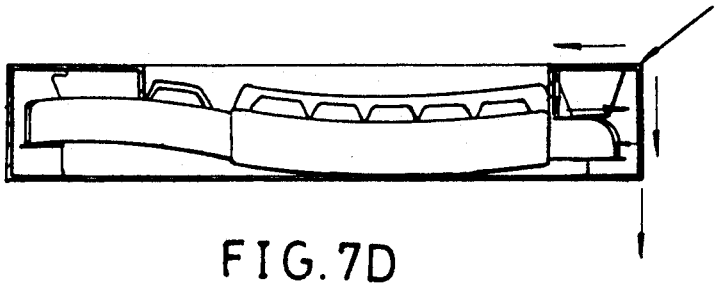
Figure 7E:
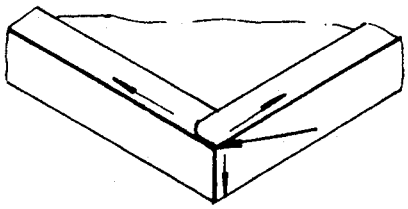

In the practice of packing of a computer keyboard 7, as shown in FIGS. 4, 5, 6, the transparent dust cover 6 is first disposed on top of the computer keyboard 7 which is then disposed on top of the box base 11, and then the engagement inserts 23, 33 are engaged with the grooves 62 of the dust cover 6 and the retaining cuts 36, 43, 53 are engaged with the round protrusions 61 respectively so as to firmly combine the transparent dust cover 6 with the present topless case and turn the same into a packing and displaying box with ease.

The addition of the reinforcement flaps 30 enables the present packing box subject to impacts of different degree without breaking up easily, and the prior art dust cover 6 is well designed to protect the keyboard from damage due to impact. As shown in FIG. 7, all possible varieties of force applied to the present packing box are illustrated and analyzed, it can be seen that the forces applied to the box can be well resolved and absorbed by the present packing box.

Figure 8A:
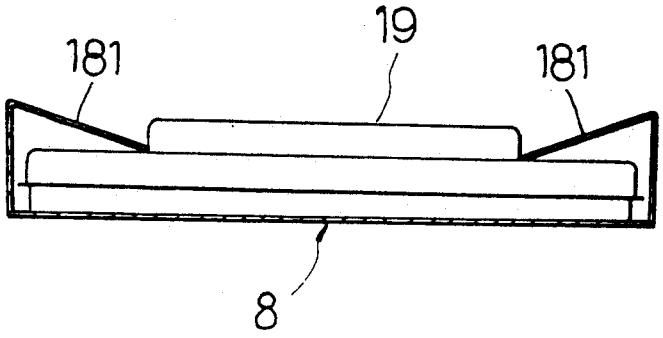
FIG. 8A is one embodiment of the present packing and displaying box.
Figure 8B:
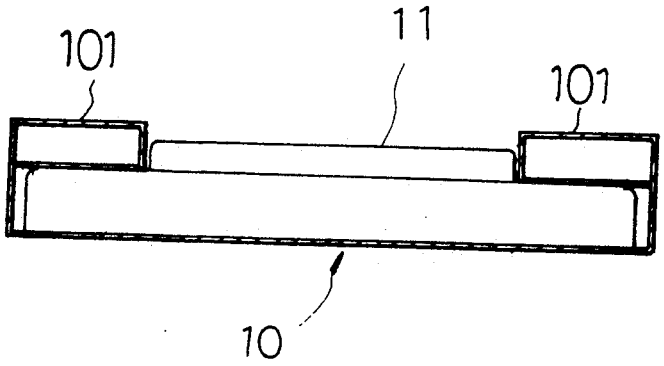
FIG. 8B is another embodiment thereof.

As shown in FIG. 8A, 8B, the packing box of the present invention can be designed in two forms, the packing box 18 as shown in FIG. 8A has a pair of declined plane folding 181 formed by a connected top fold and an inner fixing fold which can be in engagement with a hat-shaped dust cover 19. In another embodiment, as shown in FIG. 8B, the packing box 10 in engagement with a hat-shaped dust cover 11 is provided with a folding 101 made up of the top fold and the inner fixing fold in a loop form having a rectangular cross section.

It can be clearly seen that the present packing box has the following advantages over the prior art packing box:

1. The structure of the present box is simple and can be produced with ease.

2. The contained item can be clearly seen and displayed without opening or breaking up the packing box.

3. The packing box can be subject to violent impact and be held together without breaking up and has excellent buffer effect.

4. Use of the present packing box can save a lot of labor and time in assembly line when produced and packed in mass.

5. The packing box using no foamed polystyrene material is contributive to the enviromental protection.

6. It can minimize the inventory of the packing material and make the delivery of packing material easy.

7. The combination of the a conventional dust cover and the packing box of the present invention can reduce the consumption of carton material from 25% to 50%.

8. A product specification can be disposed between the computer keyboard and the transparent dust cover, and the packing boxes of the present invention are available for products supplied to different buyers in OEM manner so as to minimize the inventories of the packing boxes.

9. The transparency of the dust cover permits of check of the contained items by a worker in an assembly line with ease so as to facilitate the checking operation in a factory.

I claim:

1. An improved shock-proof packing and displaying box, comprising:

a one piece board which can be folded into a case having an opening at a top of when said box is assembled;

a modified dust cover disposed on top of an item to be packed and being located in said opening when said box is assembled;

said one piece board being provided with a box base and front, rear, left and right side flaps each respectively extended from a different corresponding side of said box base; a top fold extended from each side flap of said side flaps with a folding line disposed therebetween; front, rear, left and right inner fixing folds respectively extended from each corresponding said top fold with a folding line disposed therebetween; and a corner flap extended from each end of a front and rear side flap of said front, rear, left and right side flaps;

each end of a left and right inner fixing fold of said front, rear, left and right inner fixing folds being provided with an insertion tongue; a pair of retaining cuts on an edge of each of said left and right inner fixing fold;

an edge of each of a front and rear inner fixing fold of said front, rear, left and right inner fixing folds being provided with a number of recessed cuts so as to divide the same into a number of engagement inserts;

an elongated slot being disposed at each end of said front and rear top fold and inner fixing fold, said elongated slot extended away from said front and rear side flap, said elongated slot engageable with said insertion tongue when said box is assembled.

2. An improved shock-proof packing and displaying box as claimed in claim 1 wherein each said corner flap has an extended reinforcement flap which is comprised of a foldable base piece and a retaining piece that are foldably connected to each other; said retaining piece having an engagement insert at one end thereof which is engageable with said elongated slot together with said insertion tongue respectively when said box is assembled and a first retaining cut disposed at another end of said retaining piece corresponding in size to a retaining cut of said pair of retaining cuts, on said left and right inner fixing fold.

3. An improved shock-proof packing and displaying box as claimed in claimed in claim 1 wherein opposite ends of said modified dust cover are provided with protrusions which engage said first retaining cut and said retaining cut of said pair of retaining cuts when said box is assembled; grooves disposed on said modified dust cover engaged to said engagement inserts on said front and rear inner fixing fold when said box is assembled.

4. An improved shock-proof packing and displaying box as claimed in claim 1 wherein said top fold and each inner fixing fold of said inner fixing folds are integrally folded as one in a declined plane with respect to said side flap when said box is assembled.

5. An improved shock proof packing and displaying box as claimed in claim 1 wherein said top fold and said inner fixing fold are able to be folded in a loop form with each side thereof perpendicular to each other so as to produce a folding having a rectangular cross section.

* * * * *